US005496688A

United States Patent [19]

Okamoto et al.

[11] Patent Number: 5,496,688

[45] Date of Patent: Mar. 5, 1996

[54] BASE FILM FOR PHOTOGRAPHIC FILM

[75] Inventors: Hiroshi Okamoto, Tokyo; Kohtaro Katoh; Hiroshi Tomita, both of Sagamihara; Kenji Suzuki, Yokohama; Kazuyoshi Saitoh, Sagamihara, all of Japan

[73] Assignee: Teijin Limited, Osaka, Japan

[21] Appl. No.: 318,712

[22] PCT Filed: Feb. 7, 1994

[86] PCT No.: PCT/JP94/00181

§ 371 Date: Oct. 12, 1994

§ 102(e) Date: Oct. 12, 1994

[87] PCT Pub. No.: WO94/19722

PCT Pub. Date: Sep. 1, 1994

[30] Foreign Application Priority Data

| | | | |
|---|---|---|---|
| Feb. 16, 1993 | [JP] | Japan | 5-026763 |
| Feb. 18, 1993 | [JP] | Japan | 5-029066 |
| Feb. 19, 1993 | [JP] | Japan | 5-030520 |
| Mar. 1, 1993 | [JP] | Japan | 5-039806 |
| Mar. 1, 1993 | [JP] | Japan | 5-039807 |
| Mar. 1, 1993 | [JP] | Japan | 5-039808 |
| Mar. 1, 1993 | [JP] | Japan | 5-039809 |
| Mar. 8, 1993 | [JP] | Japan | 5-046482 |
| Mar. 30, 1993 | [JP] | Japan | 5-071753 |
| Apr. 2, 1993 | [JP] | Japan | 5-076906 |
| Apr. 2, 1993 | [JP] | Japan | 5-076907 |
| Apr. 7, 1993 | [JP] | Japan | 5-080677 |

[51] Int. Cl.[6] ..... G03C 3/02

[52] U.S. Cl. ..... 430/500; 430/496; 430/531; 430/533; 430/501; 428/480; 428/913; 428/143; 428/213; 428/220; 528/272; 528/298

[58] Field of Search ..... 430/500, 496, 430/531, 533, 501; 428/480, 913, 143, 213, 220; 528/272, 298

[56] References Cited

U.S. PATENT DOCUMENTS

| | | | |
|---|---|---|---|
| 3,875,119 | 4/1975 | Aoki et al. | 528/298 |
| 3,937,754 | 2/1976 | Shimotsuma et al. | 525/444 |
| 4,141,735 | 2/1979 | Schrader et al. | 430/141 |
| 5,258,269 | 11/1993 | Yagi et al. | 430/500 |
| 5,380,577 | 1/1995 | Hamano et al. | 428/143 |

FOREIGN PATENT DOCUMENTS

| | | |
|---|---|---|
| 48-40414 | 11/1973 | Japan . |
| 0053745 | 12/1981 | Japan . |
| 56-53745 | 12/1981 | Japan . |
| 63-2982 | 1/1988 | Japan . |
| 444030 | 2/1992 | Japan . |
| 4234039 | 8/1992 | Japan . |
| 1454956 | 11/1976 | United Kingdom . |
| 1476343 | 6/1977 | United Kingdom . |

OTHER PUBLICATIONS

Japanese Laid–Open Patent Publication No. 95,374/1975 abstract.

Japanese Laid–Open Patent Publication No. 109,715/1975 abstract.

EP 334 367 A–abstract. (corr. to Japanese Laid Open Publ. 244,446/1989).

JP A 4235036–abstract.

JP A 54–17981–abstract. (corresponds to JP B2 62–3414).

JP A 1–298350–abstract.

JP A 290652–abstract.

JP A 3–131843–abstract.

*Primary Examiner*—Thomas R. Neville

*Attorney, Agent, or Firm*—Sherman and Shalloway

[57] ABSTRACT

A base film for a photographic film, wherein (a) the refractive index (nz) in the thickness direction is at least 1.498, (b) the haze value is 2.0% or less, (c) the base film has one direction in which the tanδ value, at 80° C. by tensile viscoelasticity at 0.05 Hz, is 0.09 or less, (d) the anti-curling ratio at 70° C. is at least 45%, (e) the thickness is in the range of from 40 to 120 μm, and (f) the base film is formed from polyethylene-2,6-naphthalendedicarboxylate as a substantial raw material. This base film has various performances such as anti-curling properties, transparency and lubricity, suitable for use in a photographic film.

24 Claims, 1 Drawing Sheet

BASE FILM FOR PHOTOGRAPHIC FILM

TECHNICAL FIELD

The present invention relates to a base film for a photographic film. More specifically, it relates to a base film for a photographic film, which has anti-curling properties, transparency and lubricity and which is formed of polyethylene-2,6-naphthalenedicarboxylate as a raw material.

TECHNICAL BACKGROUND

A biaxially oriented polyethylene-2,6-naphthalenedicarboxylate film is excellent in mechanical properties, thermal properties and electric properties, and is hence studied for use in various fields. It has been put to practical use in the fields of a magnetic recording medium and electric insulation.

As one of uses of the above film, it is used in the field, for example, of photographic photosensitive materials. These photosensitive materials are largely classified into films used in the form of a sheet such as an X-ray film, a film as a printing plate and a cut film and films used in the form of a roll typified by a color or black-and-white negative film having a width of 35 mm or less. This negative film is encased in a film cartridge and the cartridge is placed in the holder of a general camera when used for taking pictures.

A biaxially oriented polyester film formed of polyethylene terephthalate is mainly used as a base for films in the form of a sheet. Further, a film formed of a cellulose-based polymer typified by triacetyl cellulose (to be sometimes referred to as TAC hereinafter) is used as a base for films in the form of a roll.

A TAC film has its characteristic features in freedom from optical anisotropy, high transparency and the property of removal of curling after developing treatment, and in particular, the excellence in the property of removal of curling is said to be a feature that does not belong to a film of any other material. Since, however, the production of the TAC film uses an organic solvent, it is necessary to take care to recycle the solvent completely for preventing the environmental pollution. In particular, the issue of environmental destruction is attracting attention in recent years, and there is a growing tendency to decrease or avoid the use of an organic solvent which may cause an environmental pollution.

On the other hand, a polyethylene terephthalate film is a film that can be formed by a melt extrusion method without any organic solvent, and a polyethylene terephthalate film is partly started to be used as a base film for a photosensitive film for photography.

However, a polyethylene terephthalate film has a problem in that it undergoes curling (curling tendency) and that it is difficult to remove the curling. That is, a base film for a photosensitive material for photography is once taken up and stored in the form of a roll, and thereafter the film is taken out of the storage, cut to a proper size and used in the form of a flat sheet such as an X-ray film, a printing plate or a cut film. In the case of a rolled film, after taking pictures, development and fixing, a negative film encased in a film cartridge in the form of a roll is cut to a predetermined length and inserted into a film album, and the film is stored in the form of sheets. However, a polyethylene terephthalate film has a problem in that it retains the curling which has occurred when the film has been taken in the form of a roll, and it curls after cut in the form of sheets.

For overcoming the curling by easing the removal of the curling which has occurred, or by decreasing the curling tendency to prevent the curling, the following proposals have been made.

Japanese Laid-open Patent Publication No. 16,783/1975 discloses a biaxially oriented laminated polyester film formed of two polyester layers, in which the intrinsic viscosity of each polyester layer is in the range of 0.35 to 1.0 but the difference between the intrinsic viscosity of one polyester layer and that of the other polyester layer is in the range of 0.02 to 0.5.

The above laminated polyester film seeks to overcome the curling by causing a curling based on a shrink stress difference between the front surface layer and the opposite surface layer and taking up the film in the direction opposite to the curling direction.

Japanese Laid-open Patent Publication No. 81,325/1975 discloses a photographic film whose base film is a biaxially oriented polyethylene2,6-naphthalenedicarboxylate film in which the ratio of Young's modulus in longitudinal direction to Young's modulus in transverse direction is in the range of 0.9 to 1.1, the saturated shrinkage percentage or saturated expansion coefficient at 180° C. is 0.9% or less, the difference between the saturated shrinkage percentage or saturated expansion coefficient in longitudinal direction and that in transverse direction at 200° C. or lower is 0.4% or less and the haze is 4.5% or less.

Japanese Laid-open Patent Publication No. 95,374/1975 discloses a process for producing a polyester film, characterized by biaxial orienting, heat setting and aging under heat in the temperature range of 40° C. to 130° C. In its Example, there is disclosed a polyethylene-2,6-naphthalenedicarboxylate film having 12 μm in thickness, obtained by the biaxial orienting at 4.3 times in the longitudinal direction and 3.5 times in the transverse direction, the heat setting at 200° C. and the aging in the temperature range of 40° to 130° C. for 24 hours.

Japanese Laid-open Patent Publication No. 109,715/1975 discloses a photographic film of which at least the base film is formed of a film which is formed of a polyester having an intrinsic viscosity (35° C., in o-chlorophenol) of at least 0.40 and containing ethylene-2,6-naphthalenediearboxylate in an amount of at least 90 mol % of whole constituent units and which has a haze of less than 5% and is biaxially oriented and heat set.

U.S. Pat. No. 4,141,735 discloses a method of decreasing the core set curling property of a film without substantially deforming or shrinking the film by heat-treating a self-supporting film having a thickness of approximately 5 to 50 mm and being formed of a thermoplastic polymer having a Tg, measured by DSC at a heating rate of 20° K./minute, of higher than about 60° C. This method is carried out by maintaining the film at a temperature between 30° .C and the Tg of the above polymer at a relative humidity of 100% or less for about 0.1 to about 1,500 hours until the core set eurling property decreases by at least 15%. This decrease in the core set curling property is measured by comparing a numerical change at an ANSI curl unit when a heat-treated film has been core-set on a core having an outer diameter of 3" at 49° C. at 50% RH for 24 hours with a numerical change at an ANSi curl unit when the corresponding film not heat-treated has been core set in the same way.

In Example 10 of the above U.S. Patent, Table 7 shows temperatures for heat-treating a poly(ethylene-2,6-naphthalenediearboxylate) film having a Tg of 198° C. and net ANSI curl values thereof in core set curling properties, and it is shown that when the treatment temperatures were 60° C., 71° C., 100° C., 120° C., 149° C. and 180° C., the net ANSI curl values were 18, 16, 13, 16, 20 and 25, respectively.

Japanese Patent Publication No. 53,745/1981 discloses a photographic film obtained by providing, as a base film, a laminated polyester film which is formed of two polyester layers respectively having intrinsic viscosities in the range of 0.35 to 1.0 and having an intrinsic viscosity difference between the layers in the range of 0.02 to 1.00 and which has curling attained by the stretching heat setting, and applying a photosensitive layer to a layer side of the base film, which side has a lower intrinsic viscosity, so that the curling of the base film is offset by the shrinkage of the photosensitive layer.

Japanese Laid-open Patent Publication No. 244,446/1989 discloses a photographic photosensitive material having a polyester base film having a haze of 3% or less and a water content of 0.5% by weight or more and at least one photosensitive layer. The feature of this photographic photosensitive material is that the base film has a water content of at least 0.5% by weight, and for obtaining this water content, an aromatic dicarboxylic acid component having metal sulfonate is copolymerized.

DISCLOSURE OF THE INVENTION

It is an object of the present invention to provide a base film for a photographic film.

It is another object of the present invention to provide a base film for a photographic film, which is excellent in anti-curling property, i.e., the performance of resisting the curling tendency or the formation of a curling, transparency and lubricity.

It is further another object of the present invention to provide a photographic base film formed of polyethylene-2,6-naphthalenedicarboxylate as a raw material.

It is further another object of the present invention to provide a photographic base film which is excellent not only in anti-curling property but also the property of removal of curling. i.e., the performance in which the removal of the curling formed by a curling tendency proceeds easily.

It is further another object of the present invention to provide a photographic base film excellent in delamination resistance and scratch resistance.

It is further another object of the present invention to provide a photographic base film excellent in flatness and almost free of thickness nonuniformity.

It is further another object of the present invention to provide a photographic film almost free from causing dust when it is cut or drilled.

It is further another object of the present invention to provide a film roll which is obtained by taking up the photographic film having the above properties, provided by the present invention, in a state where it is free of blocking, and from which the film therefore can be easily drawn out.

It is another object of the present invention to provide a base film for a photographic film, which has a very thin surface layer containing inert particles and has the above-described properties.

Other objects and advantages of the present invention will be apparent from the following description.

According to the present invention, the above objects and advantages of the present invention will be achieved, first, by a base film for a photographic film, characterized in that (a) the refractive index (nz) in the thickness direction is at least 1.498, (b) the haze value is 2.0% or less, (c) the base film has one direction in which the tanδ value, at 80° C. by tensile viscoelasticity at 0.05 Hz, is 0.09 or less, (d) the anti-curling ratio at 70° C. is at least 45%, (e) the thickness is in the range of from 40 to 120 μm, and (f) the base film is formed from polyethylene-2,6-naphthalendedicarboxylate as a substantial raw material.

PREFERRED EMBODIMENTS FOR WORKING THE INVENTION

Figure 1:
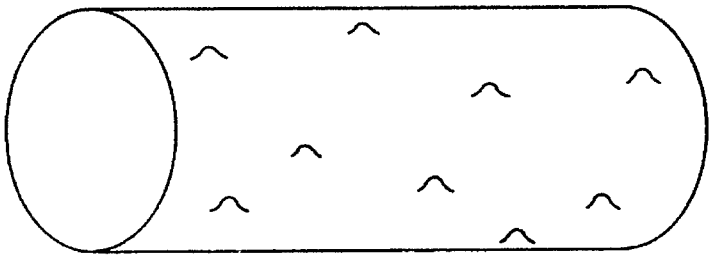
FIG. 1 is a perspective view of a film-wound roll for schemically showing a bump-like projection which occurs on the film-wound roll.

The base film for a photographic film, provided by the present invention, is defined by the constituent requirements (a) to (f) as described above.

First, the base film is substantially formed from polyethylene-2,6-naphthalenediearboxylate as defined in requirement (f). The polyethylene-2,6-naphthalenedlearboxylate is preferably selected from a homopolymer of which all the recurring units are formed of ethylene-2,6-naphthalenedicarboxylate and a copolymer of which at least 97mol % of the total recurring units are formed of ethylene-2,6-naphthalenedicarboxylate.

As a third component for forming the copolymer, examples of a compound having two ester-forming functional groups in its molecule include dicarboxylic acids such as oxalic acid, adipic acid, phthalic acid, isophthalic acid, terephthalic acid, 2,7-naphthalenedicarboxylic acid and diphenyl ether dicarboxylic acid; hydroxycarboxylic acids such as p-hydroxybenzoic acid and p-hydroxyethoxybenzoic acid; and dihydric alcohols such as propylene glycol, trimethylene glycol, tetramethylene glycol, hexamethylene glycol, neopentyl glycol and diethylene glycol.

The polyethylene-2,6-naphthalenedicarboxylate may be a polymer of which part or all whole of terminal hydroxyl groups and/or carboxyl groups are blocked, for example, with a monofunctional compound such as benzoic acid and methoxypolyalkylene glycol, or it may be a polymer which is modified with a very small amount of glycerin or an ester-forming compound having at least three functional groups such as pentaerythritol to such an extent that a substantially linear polymer can be obtained.

As the polyethylene-2,6-naphthalenedicarboxylate, preferred is a homopolymer of which all the recurring units are substantially formed of ethylene-2,6-naphthalenedicarboxylate.

The above polyethylene-2.6-naphthalenedicarboxylate may contain additives such as a stabilizer, an ultraviolet light absorbent, a colorant and a flame retardant.

The base film for a photographic film, provided by the present invention, may contain a small amount of inert fine particles for imparting it with lubricity.

The above inert fine particles are incorporated into the polyethylene-2,6-naphthalenedicarboxylate as a raw material. Examples of the inert fine particles include inorganic particles such as silica spherical particles, calcium carbonate, alumina and zeolite, and organic particles such as silicone resin particles and crosslinked polystyrene particles. When the inert fine particles are inorganic particles, synthetic inorganic particles are preferred, and they may have any crystal form.

Silica spherical particles come under preferred inert fine particles. In the silica spherical particles, each particle nearly has the form of a complete sphere, and the particle diameter ratio (largest diameter/smallest diameter) is preferably in the range of 1.0 to 1.2, more preferably 1.0 to 1.1, further preferably 1.0 to 1.05. The silica spherical particles are those present in a monodisperse state, and do not refer to spherical particles as primary particles forming aggregates. With all increase in this sphericity ratio, undesirably, a void is liable to occur around the particle, and the voids which has occurred relatively grows to increase the haze.

Further, silicone resin particles and crosslinked polystyrene particles also come under preferred inert fine particles.

As the silicone resin particles, preferred are organopolysiloxane particles of which at least 80% by weight of the structural units are formed of a structure unit represented by $CHS_3.SiO_{3/2}$. This structural unit, $CH_3.SiO_{3/2}$, is represented by the following formula.

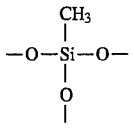

Further, the above silicone resin particles can be represented as an organopolysiloxane having a three-dimensionally bonding structure of $(CH_3.SiO_{3/2})_n$ in an amount of at least 80% by weight based on total structure units. The above n is a polymerization degree, and it is preferably at least 100. Other component includes a difunctional organopolysiloxane or a trifunctional organosiloxane derivative.

The above silicone resin particles have characteristic features in excellent lubricity, smaller specific gravity than other inert fine particles and excellent heat resistance over other organic fine particles. They further have characteristic features in insolubility in an organic solvent and non-meltability. Further, the silicone resin particles show excellent affinity to polyethylene-2,6-naphthalenedicarboxylate. The above silicone resin particles preferably have a volume form coefficient of 0.20 to $\pi/6$. The silicone resin particles having this property give a biaxially oriented film having further excellent lubricity. Further, owing to the excellent affinity of the silicone resin particles to polyethylene-2,6-naphthalenedicarboxylate, the base film is greatly improved in transparency.

As the crosslinked polystyrene particles, preferred are crosslinked polystyrene particles having a spherical form and having a narrow particle size distribution. The particle diameter ratio defined as a ratio of largest diameter to smallest diameter is preferably in the range of 1.0 to 1.2, more preferably in the range of 1.0 to 1.15, particularly preferably in the range of 1.0 to 1.12.

The crosslinked polystyrene particles are not limited by their production method. For example, spherical crosslinked polystyrene particles can be obtained by emulsion-polymerizing a styrene derivative monomer such as a styrene monomer, a methylstyrene monomer, an α-methylstyrene monomer or a dichlorostyrene monomer, one or at least two monomers selected from a conjugated diene monomer of butadiene, an unsaturated nitrile monomer such as acrylnitrile, a monomer of methacrylic acid ester such as methyl methacrylate, a functional monomer such as an unsaturated carboxylic acid, a monomer having a hydroxyl group such as hydroxyethyl methacrylate, a monomer having an epoxy group such as glycidyl methacrylate and an unsaturated sulfonic acid and a polyfunctional vinyl compound as a crosslinking agent for forming polymer particles having a three dimensional structure such as divinylbenzene, ethylene glycol dimethacrylate, trimethylolpropane triacrylate or diallyl phthalate, in an aqueous medium in which a water-soluble polymer is dissolved as a protective colloid to prepare an emulsion of polymer particles, recovering the polymer particles from this emulsion, drying the polymer particles, then smashing these particles to pieces with a jet mill and then classifying them.

The average particle diameter of the above inert fine particles is preferably in the range of 0.05 to 1.5 μm. In particular, when the inert fine particles are inorganic particles, the average particle diameter is more preferably in the range of 0.1 to 0.8 μm, particularly preferably in the range of 0.2 to 0.5 μm. When the inert fine particles are silicone resin particles, the average particle diameter is preferably in the range of 0.1 to 1.5 μm, particularly preferably in the range of 0.2 to 1.3 μm. When the inert fine particles are crosslinked polystyrene particles, the average particle diameter is more preferably in the range of 0.1 to 1 μm.

When the average particle diameter of the inert fine particles is smaller than 0.05 μm, undesirably, the effect on improvement of the film in lubricity, abrasion resistance and take-up properties is small. When it is greater than 1.5 μm, undesirably, the transparency of the film decreases.

In the particle size distribution of the inert fine particles, the relative standard deviation of the following equation is preferably 0.5 or less, more preferably 0.3 or less, particularly preferably 0.12 or less.

$$\text{Relative standard deviation} = \sqrt{\sum_{i=1}^{n} (Di - Da)^2 / n} \quad / Da$$

wherein:

Di is a diameter (μm) of each particle when the particles are taken as circles having areas, Da is an average of diameters of the particles when the particles are taken as circles having areas, $$Da = \left( \sum_{i=1}^{n} Di \right) / n \ (\mu m)$$

and, n is the number of the particles measured.

When inert fine particles having a relative standard deviation of 0.5 or less are used, projections on the film surface have very uniform heights since the particles have spherical shape and a very steep particle size distribution. Further, each projection formed on the film surface has a very sharp projection form, and the film can therefore exhibit excellent lubricity.

The content of the inert fine particles is preferably 0.001 to 0.2% by weight. When the inert fine particles are inorganic particles, the content thereof is preferably 0.001 to 0.1% by weight, more preferably 0.002 to 0.007% by weight, particularly preferably 0.003 to 0.005% by weight.

When the inert fine particles are silicone resin particles, the content thereof is preferably 0.001 to 0.1% by weight, more preferably 0.002 to 0.02% by weight, particularly preferably 0.003 to 0.01% by weight. Further, when the inert fine particles are crosslinked polystyrene particles, the content thereof is preferably 0.002 to 0.1% by weight, particularly preferably 0.003 to 0.05% by weight. When the content of the inert fine particles is less than 0.001% by weight, undesirably, the lubricity of the film is liable to be insufficient. When it exceeds 0.2% by weight, undesirably, the film shows increased haze and insufficient transparency.

The inert fine particles may be added at any time before the polyethylene-2,6-naphthalenedicarboxylate is formed into a film. For example, they may be added at the step of polymerization or at a step prior to the film formation.

The refractive index nz of the base film for a photographic film, provided by the present invention, is at least 1.498 (requirement (a)). When this refractive index (nz) is less than 1.498, improperly, the film is liable to undergo delamination, the damage caused by scratching is liable to have a corrugated edge (concave and convex), and the delaminated portion and the damaged portion come in sight white.

The refractive index (nz) in the film thickness direction is a value obtained with an Abbe refractometer relative to Na-D ray at 25° C., and it is a value obtained by measuring both surfaces of a film and taking the average of the measurement values.

The refractive index (nz) can be increased by decreasing the stretch ratio of the film and increasing the heat setting temperature. However, when the stretch ratio is decreased to excess or when the heat setting temperature is increased to excess, a nonuniformity in the film thickness grows and a flute is liable to occur on the film surface.

The refractive index (nz) is preferably 1.510 or less.

The base film for a photographic film, provided by the present invention, has a haze value of 2.0% or less (requirement (b)). The haze value is preferably 1.5% or less, particularly preferably 1.0% or less. When this haze is too high, undesirably, the transparency of the film is low.

Further, the base film for a photographic film, provided by the present invention, has one direction in which the tanδ value, at 80° C. by tensile viscoelasticity at 0.05 tlz, is 0.09 or less (requirement (c)) . The tanδ value is preferably less than 0.085, more preferably 0.08 or less, further preferably 0.06 to 0.07.

When the tanδ value exceeds 0.09, the film is liable to have curling tendency, and is not sufficient in terms of performance as a base film for a photographic film.

It is one of the greatest characteristic features of the base film for a photographic film, provided by the present invention, that the base film has the anti-curling property. As an index for directly showing it, the anti-curling ratio at 70° C. is at least 45% (requirement (d)). The anti-curling ratio is preferably at least 50%. The highest temperature to which a photographic film is generally exposed in a daily life is about 70° C., and there is known no film which shows such a high anti-curling ratio at 70° C.

Conventionally, the curling tendency of a photographic film is evaluated on the basis of degrees to which the curling caused by the curling tendency is removed through the steps of developing and drying the photographic film.

However, the base film for a photographic film, provided by the present invention, is excellent in the property of being almost free from undergoing curling, i.e., the anti-curling properties, and yet it is also excellent in the property of removing the curling, i.e., the property with which the curling once caused by curling tendency is easily removed.

At 49° C. lower than 70° C. by 21° C., the base film of the present invention shows excellent anti-curling properties as well. That is when the base film of the present invention is core-set (heat-treated) on a core having an outer diameter of 3 inches at 49° C. at 50% RH for 24 hours, the net ANSI curl value is preferably 10 or less.

The base film for a photographic film, provided by the present invention, has a thickness in the range of 40 to 120 μm (requirement (e)). The thickness is preferably 50 to 100 μm.

The base film of the present invention can be advantageously produced by biaxially orienting an unstretched film obtained by a conventional method, heat setting the biaxially oriented film, and annealing the resultant film. The biaxial orienting treatment may be carried out by any one of consecutive biaxial orienting in the length and width directions and simultaneous biaxial orienting. Further, the biaxially oriented film may be further reoriented in the length or width direction or in both directions. As the orienting conditions, conventionally known conditions may be employed. For example, the ratio is properly 2.0 to 5.0 times. Meanwhile, a biaxially oriented film formed under conventional conditions has a tanδ value, at 80° C. by tensile viscoelasticity at 0.05 Hz, of about 0.10 in the longitudinal direction. It is required to decrease this tanδ value to 0.09 or less. As a means of decreasing the tanδ value, there is employed a method in which the film is annealed at a temperature between a temperature higher than a temperature at which the film has a heat history in a roll state and 150° C. or less, and further, preferred and more effective is a method in which the film is annealed at a temperature between a temperature higher than the temperature at which the film has a heat history, by 10° C., and 130° C. or less. For preventing the curling tendency, it is insufficient to anneal the film at a temperature equal to or lower than a temperature at which the film has a heat history in a roll state. On the other hand, when film is annealed at a temperature higher than 150° C., undesirably, oligomers are liable to precipitate on the film surface and a core is liable to be imprinted on the film surface, so that there is a disadvantage in the use of the film.

The method for annealing the biaxially oriented film includes a method in which the biaxially oriented and heat set film is heated while it is in contact with a heating roll without having been once taken up, a method in which the film is heated with hot air while it is allowed to run and out of contact, a method in which the film is once taken up and then heated by any one of the above methods while it is being taken out, and a method in which the film is heat-treated in a heating oven while it is in a roll state.

In the heat setting after biaxial orienting, the heat setting zone which follows the biaxial orienting is divided into multi-stages, the heat setting temperature is gradually decreased so that no sharp temperature change is applied, whereby the refractive index (nz) in the thickness direction can be easily increased to 1.498 or more without increasing nonuniformity in thickness or causing a flute. Further, this effect is further promoted when the film is contracted in the width direction by narrowing the width of stenter rails in the heat setting zone having the highest temperature.

For example, preferably, the heat setting zone which follows the biaxial orienting is divided into at least three zones, preferably at least four zones, and the final zone in the thermosetting zone is set at a temperature of 140° C. or lower, preferably 120° C. or lower.

From the zone having the highest temperature to the final zone, it is preferred to decrease the temperature gradually so that no sharp temperature change is applied. In this case, the temperature gradient between neighboring zones is 70° C. or lower, preferably 60° C. or lower.

The base film of the present invention can be further imparted with the following properties as a base film for a photographic film.

The film/film adhering degree of the base film of the present invention is preferably 3rd grade or lower, more preferably 2.5th grade or lower, particularly preferably 2nd grade or lower. With an increase of the adhering degree in the grade, the film shows resistance to slipping. With a decrease in the grade, the film shows tendency toward film/film slipperiness. When the adhering degree is greater than 3rd grade, the film/film slipperiness is poor, the film/film blocking takes place, scratching occurs due to a conveyer roll or the like at a film running time, and bump-like projections are liable to occur at the time of taking up the film. These are undesirable for use of the film for a photographic film.

The base film of the present invention preferably has a flatness of 250 cm/m-width or less. When the film flatness exceeds 250 cm/m-width, improperly, it is difficult to apply an emulsion of a photosensitive material uniformly. The flatness is particularly preferably 200 cm/m-width or less.

When thermally analyzed, the base film of the present invention preferably shows an endothermic peak in the range of 120° to 160° C., preferably 130° to 150° C. The endothermic energy represented by the integral area of the endothermic peak is preferably 0.3 mJ/mg or more, more preferably 0.5 mJ/mg or more. When the endothermic peak is within the above temperature range and has the above energy, the base film of the present invention sufficiently shows excellent anti-curling properties.

When subjected to dry heat treatment at 150° C. for 30 minutes, the base film of the present invention shows a heat shrinkage percentage, in one direction, preferably of 3% or less more preferably 2% or less, particularly preferably 1.5% or less. The base film of the present invention is allowed to have a thickness nonuniformity, which is preferably 5 μm or less, more preferably 4 μm or less. When the thickness nonuniformity exceeds 5 μm, it is difficult to apply an emulsion of a photosensitive material to the film surface uniformly, which in some cases, may decrease the quality of the photographic film.

The thickness nonuniformity is effectively decreased by increasing the stretch ratio and decreasing the heat setting temperature, the temperature for stretching in the longitudinal direction and the temperature for stretching in the transverse direction.

In the base film of the present invention, further, the Young's moduli in two directions crossing each other at right angles are preferably 750 kg/mm$^2$ or less, more preferably 700 kg/mm$^2$. When these Young's moduli exceed 750 kg/mm$^2$ a large amount of dust is liable to occur at the time of cutting or perforation drilling. The lower limit of each of the Young's moduli in the longitudinal direction and transverse direction is preferably 400 kg/mm$^2$ further preferably 450 kg/mm$^2$.

Although not specially limited, the Young's modulus difference between these two directions is preferably 150 kg/mm$^2$ or less.

As described above, the base film of the present invention basically has the anti-curling properties, transparency and lubricity, while the studies of the present inventor have further revealed that there can be provided a base film which is further improved in lubricity alone without impairing the curling properties and transparency.

That is, according to the present invention, secondly, there is provided a base film for a photographic film, which is formed of a laminate comprising a first layer formed of polyethylene-2,6-naphthalenedicarboxylate which may contain less than 0.003% by weight of inert fine particles having an average particle diameter of 0.01 to 1.5 μm and a second layer which is formed of polyethylene-2,6-naphthalenedicarboxylate containing 0.003 to 0.5% by weight of inert fine particles having an average particle diameter of 0.01 to 1.5 μm and has a thickness of 10 μm or smaller.

Like the foregoing base film of the present invention, the above base film for a photographic film (to be referred to as "second base film of the present invention" hereinafter) satisfies all the above requirements (a), (b). (c), (d) and (e).

As described above, the second base film of the present invention is formed of a laminated film of the first and second layers of which the inert fine particle contents differ. The second layer having a larger content of the inert fine particles and having a very small thickness is laminated only on one surface of the first layer, or there are two second layers laminated on both the surfaces of the first layer.

The first layer may contain inert fine particles having an average particle diameter of 0.01 to 1.5 μm, and when it contains the inert fine particles, the amount of the inert fine particles is less than 0.003% by weight, preferably 0.001% by weight or less.

It should be understood that the description of the inert fine particles for the initially described base film of the present Invention shall be directly applied to the inert fine particles having an average particle diameter of 0.01 to 1.5 μm unless otherwise specified here.

The content of the inert fine particles in the first layer is less than 0.003% by weight. The thickness of the second base film of the present invention is 50 to 120 μm (requirement (e)), and the thickness of the second layer is 10 μm at the largest as described above. It can be therefore understood that the thickness of the first layer is very large as compared with that of the second layer. That is, the first layer which contains no inert fine particles or a very small amount of inert fine particles is made to have a large thickness, whereby the thickness of the first layer in the total thickness of the base film is made large, so that the transparency of the base film is advantageously secured.

The second layer contains 0.003 to 0.5% by weight of inert fine particles having an average particle diameter of 0.01 to 1.5 μm.

The inert fine particles for the second layer should be understood to be the same as those for the first layer.

The content of the inert fine particles in the second layer is preferably 0.005 to 0.3% by weight, more preferably 0.01 to 0.1% by weight. When the content of the inert fine particles is less than 0.003% by weight, the film is poor in lubricity, and the film/film blocking is liable to occur. When it exceeds 0.5% by weight, undesirably, the film is poor in scratch resistance and transparency.

The ratio ($t_2/d_2$) of the thickness $t_2$ (μm) of the second layer to the average particle diameter $d_2$ (μm) of the inert fine particles contained in said second layer is preferably in the range of 0.1 to 10, more preferably 0.2 to 5, further preferably 0.3 to 3. When this ratio ($t_2/d_2$) is smaller than 0.1, inert fine particles in the film surface layer portion are liable to drop off at a film running time, and the film is also poor in lubricity. When it is greater than 10, undesirably, the film is defective in scratch resistance.

The important function of the second layer is to impart the second base film with lubricity.

The thickness of the second layer (each second layer when there are two second layers, one on one surface of the first layer and the other on the other surface of the first layer) is 10 μm or less, preferably 5 μm or less. The lower limit of the thickness is preferably set at 0.1 μm.

The biaxially oriented laminated film for the second base film of the present invention can be produced by a method in which polyethylene-2,6-naphthalenedicarboxylate for the first layer and polyethylene-2,6-naphthalenedicarboxylate for the second layer, or compositions containing these, are melted separately from each other and co-extruded through a die, the extruded films are lamination-fused to each other before their solidification to form an unstretched film, and the unstretched film is biaxially oriented and heat set, or a method in which the polymers or compositions are melted and extruded separately from each other to form films, and these films are lamination-fused in an unstretched state or after they are stretched. Then, the resultant biaxially oriented laminated film is annealed in the same manner as in the annealing which is already described, whereby the second base film of the present invention can be obtained.

It should be understood that as for the parts not described with regard to the second base film of the present invention, the previously-given corresponding description of the base film of the present invention can be directly applied thereto.

According to the present invention, there is similarly provided a taken-up roll of a base film for a photographic film, in which the base film of the present invention (including the second base film, the base film will be used in tills sense hereinafter) is taken up and maintained in a blocking-free state.

That Is, the taken-up roll of the base film for a photographic film, provided by the present invention, has characteristic features in that the rolled film is the base film of the present invention and 7 to 20% by volume of an air layer is present between rolled film layers.

In the taken-up roll of the present invention, the film is taken up such that the air layer is present between rolled film layers in an amount of 7 to 20% by volume, preferably 8 to 19% by volume, further preferably 10 to 18% by volume. When the amount of the air layer is less than 7% by weight, undesirably, blocking or the aforementioned fine scratch occurs due to the tightening of the roll caused by the annealing. On the other hand, when the amount of the air layer exceeds 20% by volume, these problems do not occur. Undesirably, however, the form of the taken-up roll is unstable, the end surface of the roll becomes nonuniform at the time of taking up the film, or the roll is deformed when transported.

The method of adjusting the air amount in the film/film interface to the above range includes a method in which the film is taken up while a film having a small width is inserted and kept on each roll edge side, and a method in which the film is processed on each roll edge side in advance so as to have an uneven surface (e.g., embossing), although no limitation shall be imposed on the method.

A variety of thin layers including a photosensitive emulsion layer can be formed on the surface of the base film of the present invention to obtain a photographic film. These thin layers can be formed by known means.

EXAMPLES

The present invention will be detailed hereinafter with reference to Example, although the present invention shall not be limited to these Examples.

In Examples and Comparative Examples, samples were measured for tanδ, refractive indices (nz) in the thickness direction, anti-curling ratios, folded-line delamination whitening ratio, and the like in the following manners.

(1) Refractive index (nz) in the thickness direction

A film sample is measured for a refractive index in the thickness direction at 25° C. with an Abbe refractometer (supplied by Atago K.K.) using Na-D ray. The film sample is measured on both front and reverse surfaces, and the average value is taken as a refractive index (nz).

(2) Haze

Total haze value per one sheet of a film, measured with a commercially available haze meter according to the procedures specified in JIS K-6714.

(3) tanδ

Measured under the following conditions with a thermal stress distortion measuring apparatus TMA/SS120 supplied by Seiko Instruments Inc.

Load mode: sin wave (load variation frequency 0.05 Hz)

Mean value of load per cross-sectional area: 120 g/mm$^2$

Amplitude of load per cross-sectional area: 90 g mm$^2$

Temperature elevation rate: 5° C./minute

Sample width: 4 mm

Sample length (interchuck distance): 10 mm

Measurement direction: Longitudinal direction (4) Anti-curling ratio

A sample film having a size of 120 mm×35 mm is wound around a take-up core having a diameter of 10 mm and temporarily fixed so that it is not unwound. Then, the sample film is heated at 70° C. at 30 % RH for 72 hours, then released from the take-up core and immersed in 40° C. distilled water for 15 minutes. Then, a load of 50 g is applied so that the sample film is perpendicularly suspended, then the sample is dried at 55° C. for three minutes in a constant temperature furnace and the sample film is measured for "sample length" (mm) in a curling-remaining state after the removal of the load. The ratio (%) of the sample length to the initial sample length 120 mm is taken as the anti-curling ratio.

When a sample greatly curls to form a circle or a half circle, the "sample length" refers to the diameter, and when a sample curls to small extent to form an arc short of a half circle, it refers to the length of the chord.

The anti-curling ratio shows that with an increase in this curling ratio, a film sample is more free of curling imparted.

(5) Net ANSI curl value

The evaluation of curling was carried out according to the test method A (21° C., 50% RH) of ANSI/ASC PH1.29-1971. A curling was imparted by taking up a film about a core having an outer diameter of 3 inches and treating the film at 49° C. at 50 % RH for 24 hours. The film to be imparted with the curling has a size of 4 inches×6 inches.

Net ANSI curl value is calculated by deducting ANSI curl value before taking up the film around the core from ANSI curl value after impartation with a curling by taking up a film around a core.

(6) Adhering degree

A rubber plate is placed on a flat base, and two films containing no dust or no foreign matter are stacked thereon. A column-shaped weight having an outer diameter of 70 mm and weighing 10 kg is gently placed on the film from right above the film, and after 10 minutes, the weight is gently removed. After 30 seconds, a photograph of a contact pattern in the remaining circle formed by the weight is taken, a ratio of areas of adhering portions is measured, and rated on the basis of grades 0 to 5 in Table 1.

TABLE 1

| Grade | Ratio (%) of adhering portions |
|---|---|
| 0 | less than 10% |
| 1 | at least 10%, less than 30% |
| 2 | at least 30%, less than 50% |
| 3 | at least 50%, less than 70% |
| 4 | at least 70%, less than 90% |
| 5 | at least 90% |

(7) Flatness

A film sample having a length of 2 m is taken from a rolled film, and spread over on a horizontal and flat base so that the surface of the film which has constituted the surface of the rolled film faces upwardly. The sample film is allowed to be spread for 10 minutes, and the entire surface of the film sample is observed. Flutes remaining on said surface are measured for lengths (cm), anti their total is divided by the film width (m) to determine the flatness.

Flatness (cm/m-width)=total of flute lengths (cm)/film width (m)

(8) Endothermic peak temperature $T_k$ (°C.)

A film in an amount of 10 mg is set in a thermal analysis system SSC580DS (DSC) supplied by Seiko Instruments Inc, and heated in $N_2$ current at a temperature elevation rate of 20° C./min. The endothermic behavior of the film is analyzed by primary differential calculus and secondary differential calculus to determine a peak-showing temperature, which is taken as the endothermic peak temperature.

(9) Endothermic energy $\Delta H_k$ (mJ/mg)

In the same manner as in (8), 10 mg of a film is set in a thermal analysis system SSC580, SDC20 supplied by Seiko Instruments Inc, and heated in $N_2$current at a temperature elevation rate of 20° C./min. The endothermic energy is determined on the basis of an endothermic side area on a DSC chart corresponding to the endothermic energy of the film.

The above area is an area on an endothermic side, formed by a line which deviates from a base line to arm endothermic side when the temperature is elevated, goes through the endothermic peak when the temperature elevation is further continued, and then returns to the base line position. A position where endotherm initiates and a position where endotherm finishes are connected by a straight line, and an area (A) is determined. Indium is measured under the same DSC measurement conditions, and this area (B) is taken as 28.5 mJ/mg. The endothermic energy is determined by the following equation.

$$(A/B)\times 28.5=\Delta H_k \text{ (mJ/mg)}$$

(10) Heat shrinkage percentage

A sample is held in hot air at 150° C. for 30 minutes, and a dimensional change is determined by the following equation.

$$\text{Heat shrinkage percentage} = \frac{L_0 - L}{L_0} \times 100\ (\%)$$

wherein $L_0$ is a distance between gauge points before heat shrinkage, and

L is a distance between the gauge points after the heat shrinkage.

(11) Thickness nonuniformity of film

A film is measured with an electronic micrometer K-312A supplied by Anritsu K.K. at a needle pressure of 30 g at a running rate of 25 mm/second in the longitudinal direction and in the transverse direction through the length of 2 m each, to obtain a continuous thickness chart at the sensitivity of ±4 μm. On the basis of this chart, a maximum value and a minimum value in thickness in the length of 2 m are determined, and a difference (μm) between these is taken as the thickness nonuniformity.

(12) Young's modulus

A film is cut to prepare a sample having a width of 10 mm and a length of 15 cm, and the sample is tensioned with an Instron type universal tensile tester at an interchuck distance of 100 mm at a tension rate of 10 mm/minute at a chart rate of 500 mm/minute. The Young's modulus is calculated on the basis of the tangent of rise portion of the resultant load-elongation curve.

(13) Form of taken-up film

A film having a width of 500 mm and a length of 500 m is taken up in the form of a roll. The roll of the taken-up film is visually inspected to count the number of bump-like projections having a major diameter of at lease 1 mm, as schematically shown in FIG. 1. The form of the roll is rated on the basis of grades 1 to 5 as shown in Table 2. Grades 4 and 5 are below standard.

TABLE 2

| Grades | Number of projections (pieces) |
|---|---|
| 1 | 0 |
| 2 | 1–2 pieces |
| 3 | 3–5 pieces |
| 4 | 6–10 pieces |
| 5 | 11 pieces or more |

(14) Folded-line delamination whitening ratio

A film is cut to prepare a sample having a size of 80 mm×80 mm, and while the sample is manually and lightly folded into two, the sample is sandwiched between a pair of flat metal plates and pressed with a pressing machine under a predetermined pressure $P_1$ (kg/cm$^2$G) for 20 seconds. After the pressing, the two-folded film is manually restored to its original state and then pressured with the above pressing machine under a predetermined pressure $P_1$ (kg/cm$^2$G) for 20 seconds. Then, the sample is taken out and measured for lengths (mm) of whitened portions appearing in the folded line, and the measured lengths are totaled.

Fresh samples are prepared from one film, and respectively tested in the same manner as above under the pressure $P_1$=1, 2, 3, 4, 5 or 6 (kg/cm$^2$G).

The ratio of the average value or the total of lengths (mm) off whitened portions under each pressure to the total length (80 mm) of the folded line is taken as the folded-line delamination whitening ratio, and this value is used as an index showing the likelihood of delamination of the film.

Folded-line delamination whitening ratio (%) =total lengths (mm) of whitened portions/(80 mm×6)×100

(15) Dust occurrence state

A film perforated with a perforator is allowed to run 100 m at a rate of 10 m/minute with keeping the perforated portion of the film in contact with the adhesive surface of an adhesive tape (Nitto protection film SPV-363, supplied by Nitto Denko K.K.) which is attached to a metal roll having a diameter of 10 cm, and the amount of dust adhering to the adhesive tape is visually observed and rated as follows.

⊙: No adhering dust is observed.

○: Almost no adhering dust is observed.

Δ: Adhering dust is observed to some extent.

×: A large amount of adhering dust is observed.

(16) Blocking after annealing

A film having a width of 500 mm and a length of 500 m is taken up in the form of a roll, and the roll is annealed at 110° C. for 24 hours. The surface of the annealed roll is cut out to remove 400 m of the film, and the remaining core portion is visually observed to see the presence or absence of blocking. The evaluation is conducted on the basis of the following standard.

○: No blocking occurs, and the roll surface is flat.

Δ: There are 3 to 5 blockings in the form of a rice grain, while the remaining portion is flat.

×: There are at least 6 blockings in the form of a rice grain, or there is at least one blocking having a size of at least 10 $mm^2$.

(17) Scratch resistance

A film surface is scratched about 100 mm in the film longitudinal direction with a scratch tester model Haydon-14 (supplied by Shinto Kagaku K.K.) using a diamond needle having a tip radius of 50 μm as a scratch needle under a needle load of 200 g at a running rate of 2 mm/second.

The scratched portion is observed through a transmission microscope having a magnification of 100 times, and its state is rated as shown in Table 3.

TABLE 3

Figure 2A:
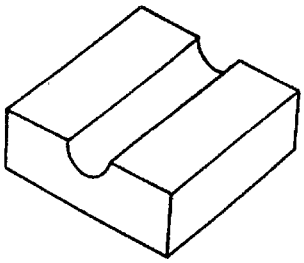
FIG. 2('a), 2(*b*) and 2(*c*) are partially enlarged perspective views schematically showing the state of a scratch on a film surface. The FIGS. 2(*a*), 2(*b*) and 2(*c*) show different states of scratches.
Figure 2B:
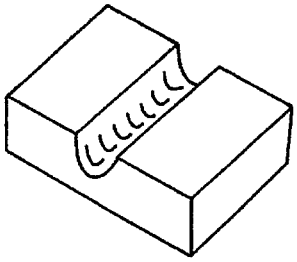
Figure 2C:
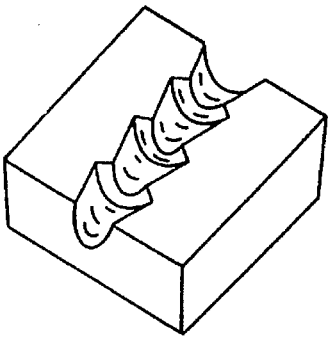

| Rank | State observed through microscope | Form |
|---|---|---|
| A | A groove-shaped scratch is observed, but not noticeable. | FIG. 2(a) |
| B | A scale-like pattern is observed in a groove, and a scratch is noticeable to some extent. | FIG. 2(b) |
| C | Cleavage (concave and convex) locally occurs as the needle moves, and a whitened scratch is noticeable. | FIG. 2(c) |

The film belonging to the ranks A and B practically acceptable.

(18) Proportion of air layer

A film having a predetermined length is taken up in the form of a roll, and the roll diameter D measured. Separately, the roll diameter $D_0$ is calculated on the basis of the film thickness and length (without air layer present). The proportion of the air layer is calculated on the basis of the above calculated value and measurement value by the following equation.

$$\text{Proportion of air layer} = \frac{D - D_0}{D_0} \times 100$$

(19) Average particle diameter of particles

A centrifugal particle size analyzer Model CP-50 supplied by Shimadzu Corporation is used for the measurement. A particle diameter corresponding to 50 mass percent is read on an accumulative curve of particles having sizes and their amounts calculated on the basis of a centrifugal precipitation curve obtained, and this value is taken as the above average particle diameter (see "Particle Size Measurement Technique", issued by Nikkan Kogyo Shinbunsha, 1975, pages 242–247).

(20) Volume form coefficient (f)

Photographs of lubricant particles in 10 fields of vision are taken through a scanning electron microscope at a magnification of 5,000 times, an average value of largest diameters is calculated each vision with an image analyzing device Luzex 500 (supplied by Nippon Regulator K.K. ). An average value of those in the 10 fields of vision is determined, and taken as D.

The volume of the particle is calculated on the basis of the average particle diameter d obtained in the above section (19) according to $V=(\pi/6)d^3$, and the value for coefficient f is calculated by the following equation.

$$f=V/D^3$$

wherein V is the volume ($\mu m^3$) of the particle and D is the largest diameter (μm) of the particle.

(21) Particle diameter ratio

A piece of a film is fixed in a cured epoxy resin, and an ultra-thin section having a thickness of about 600 angstrom is prepared (by cutting the film in parallel with the film flow direction). The cross-sectional form of lubricants in this sample film was observed through a transmission electron microscope (H-800, supplied by Hitachi Ltd.), and the particle diameter ratio is represented by the ratio of the largest diameter of particles to the smallest diameter thereof.

(22) Average particle diameter, particle diameter ratio, etc., of particles

A powder is dispersed on an electron microscope sample stage such that particles hardly overlap, and gold is deposited on their surface with a gold sputtering apparatus to form a deposition layer of a gold thin film having a thickness of 200 to 300 angstrom. While the surface is observed through a scanning electron microscope at a magnification of 10,000 to 30,000 times, the largest diameters (Dli), smallest diameters (Dsi) and area circle correspondence (Di) of at least 100 particles are determined using Luzex 500 supplied by Nippon Regulator KK. The largest diameter (Dl), smallest diameter (Ds) and average diameter (Da) of the particles are determined on the basis of the number average values obtained by the following equations. Further, the particle diameter ratio is determined on the basis of these.

$$Dl = \left( \sum_{i=1}^{n} Dli \right) / n$$

$$Ds = \left( \sum_{i=1}^{n} Dsi \right) / n$$

$$Da = \left( \sum_{i=1}^{n} Di \right) / n$$

Further, the values of particles in a film are determined as follows.

A sample film piece is fixed on a sample stage for a scanning electron microscope, and the film surface is ion-etched with a sputtering apparatus (ion-etching apparatus JFC-1100) supplied by Nippon Denshi K.K. under the following conditions. The sample is placed in a bell jar, and the vacuum degree is increased up to a vacuum state of about $10^{-3}$ Torr. The ion-etching is carried out at a voltage of 0.25 KV, a current of 12.5 mA for about 10 minutes. Further, in the same apparatus, gold sputtering is carried out on the film surface, and while the film surface is observed through a scanning electron microscope at a magnification of 10,000 to 30,000 times, the largest diameters (Dli), smallest diameters (Dsi) and area circle correspondence (Di) of at least 100 particles are determined using Luzex 500 supplied by Nippon Regulator K.K. Then, the above-mentioned procedures are conducted thereafter.

Examples 1–4 and Comparative Examples 1–3

A polyethylene-2,6-naphthalenedicarboxylate containing inert fine particles shown in Table 4 and having an intrinsic viscosity of 0.60 was melt-extruded through a die slit, and cooled and solidified on a casting drum to prepare an unstretched film. Then, the unstretched film was stretched 3.0 times in the longitudinal direction at 130° C., and then stretched 3.3 times in the transverse direction at 135° C. while holding both sides of the film in the transverse direction with stenter clips. Further, the stretched film was heat set under tension at 230° C., then released and rapidly cooled by bringing the film into contact with a rapidly cooling roll under tension, and the biaxially oriented film was taken up in the form of a roll.

A film having a width of 500 mm and a length of 500 m was sampled from the above-obtained biaxially oriented film, and taken up about a take-up core having a diameter of 165 mm to prepare a sample roll. The sample roll was annealed in this state under the conditions shown in Table 4.

The physical properties of the annealed biaxially oriented film were as shown in Table 4.

The biaxially oriented films obtained in Examples 1 to 4 are those which were annealed to have predetermined tanδ value, and these films satisfy the properties required as a material for a photographic film.

On the other hand, the biaxially oriented film obtained in Comparative Example 1 is an example which was not annealed, and no sufficient capability of recovery from curling is obtained. Comparative Example 2 is an example in which no desired tanδ value was obtained since the annealing temperature was too high and as a result, no sufficient capability of recovery from curling was obtained.

Comparative Example 3 shows an example in which no sufficient transparency is obtained since the amount of the lubricant is too large.

TABLE 4

| | Particles added | | | | Film | Annealing conditions | | Annealed film | |
|---|---|---|---|---|---|---|---|---|---|
| | Kind | Average particle diameter (μm) | Largest diameter/ smallest diameter | Amount (wt %) | thick-ness (μm) | Tempe-rature (°C.) | Time (hr) | Refrac-tive index nz | Haze (%) |
| Ex. 1 | spherical silica | 0.3 | 1.07 | 0.005 | 75 | 90 | 24 | 1.503 | 0.9 |
| Ex. 2 | spherical silica | " | " | " | " | 100 | " | " | " |
| Ex. 3 | spherical silica | " | " | 0.01 | " | 90 | " | " | 1.6 |
| Ex. 4 | spherical silica | " | " | " | " | 100 | " | " | " |
| CEx. 1 | spherical silica | " | " | 0.005 | " | not carried out | | " | 0.9 |
| CEx. 2 | spherical silica | " | " | " | " | 150 | " | " | " |
| CEx. 3 | spherical silica | " | " | 0.20 | " | 100 | " | " | 4.8 |

| | Annealed film | | | | Evaluation for photographic film | | | |
|---|---|---|---|---|---|---|---|---|
| | Adhering degree (Grade) | Form of annealed roll of film | tan δ | Anti-curling ratio (%) | Trans-paren-cy | Form of roll (Grade) | Capabi-lity of recovery from curling | Overall evalua-tion |
| Ex. 1 | 3 | 2 | 0.075 | 80 | ○ | 2 | ○ | ○ |
| Ex. 2 | " | " | 0.070 | 90 | ○ | " | ○ | ○ |
| Ex. 3 | 2 | 1 | 0.075 | 80 | ○ | 1 | ○ | ○ |
| Ex. 4 | " | " | 0.070 | 90 | ○ | " | ○ | ○ |
| CEx. 1 | 3 | 2 | 0.10 | 35 | ○ | " | X | X |
| CEx. 2 | " | 4 | 0.092 | 55 | ○ | " | X | X |
| CEx. 3 | 1 | 1 | 0.070 | 90 | X | " | ○ | X |

Ex. = Example, CEx. = Comparative Example

Examples 5–6 and Comparative Examples 4–5

Annealed biaxially oriented films were obtained in the same manner as in Examples 1 to 4 except that the polyethylene-2,6-naphthalenedicarboxylate was replaced with a polyethylene-2,6-naphthalenedicarboxylate containing fine particles shown in Table 5 and having an intrinsic viscosity of 0.60.

Table 5 shows the properties of the obtained annealed biaxially oriented films.

TABLE 5

| | Particles added | | | | | Annealed film | | | | | Evaluation for photographic film | | | |
|---|---|---|---|---|---|---|---|---|---|---|---|---|---|---|
| | Kind | Average particle diameter (μm) | Volume form coefficient | Amount (wt %) | Film thickness (μm) | Refractive index nz | Haze (%) | tan δ | Anti-curling ratio (%) | Adhering degree (Grade) | Form of roll (Grade) | Transparency | Lubricity | Overall evaluation |
| Ex. 5 | Silicon resin fine particles | 0.3 | 0.20 | 0.005 | 75 | 1.503 | 0.8 | 0.07 | 90 | 3 | 2 | ○ | ○ | ○ |
| Ex. 6 | Silicon resin fine particles | 0.3 | 0.40 | 0.01 | 75 | " | 1.4 | " | " | 2 | 1 | ○ | ○ | ○ |
| CEx. 4 | Silicon resin fine particles | 0.3 | 0.40 | 0.20 | 75 | " | 4.2 | " | " | 1 | 1 | X | ○ | X |
| CEx. 5 | Calcium carbonate | 0.8 | 0.25 | 0.01 | 75 | " | 2.3 | " | " | 4 | 4 | X | X | X |

Ex. = Example, CEx. = Comparative Example

Examples 7–10 and Comparative Examples 6–7

A polyethylene-2,6-naphthalenedicarboxylate having an intrinsic viscosity of 0.60 was melt-extruded through a die slit by a conventional method, and rapidly cooled and solidified on a casting drum to prepare an unstretched film.

TABLE 6

| | Stretching in longitudinal direction | | Stretching in transverse direction | | Heat-setting zone | | | | | |
|---|---|---|---|---|---|---|---|---|---|---|
| | | | | | $X_1$ | | $X_2$ | $X_3$ | $X_4$ | Annealing |
| | Stretch ratio | Temperature (°C.) | Stretch ratio | Temperature (°C.) | Temperature (°C.) | Shrinkage percentage (%) | Temperature (°C.) | Temperature (°C.) | Temperature (°C.) | conditions* |
| Ex. 7 | 3.0 | 135 | 3.0 | 145 | 240 | 6 | 215 | 180 | 110 | Condition A |
| Ex. 8 | " | " | " | " | " | " | " | " | " | Condition B |
| Ex. 9 | 2.7 | " | " | " | " | 2 | " | " | " | Condition A |
| Ex. 10 | " | " | " | " | 230 | 6 | 200 | 170 | " | Condition A |
| CEx. 6 | 3.0 | " | " | " | 240 | " | 215 | 180 | " | No annealing |
| CEx. 7 | " | " | 3.3 | " | 220 | " | " | " | " | Condition A |

Ex. = Example, CEx. = Comparative Example
*: Annealing conditions:
Condition A: Temperature-increased up to 100° C. over 24 hours, maintained for 24 hours, and temperature-decreased to room temperature over 24 hours.
Condition B: Temperature-increased up to 90° C. over 24 hours, maintained for 24 hours, and temperature-decreased to room temperature over 24 hours.

The above unstretched film was biaxially oriented and heat set under conditions shown in Table 6 and further annealed under conditions shown in Table 6 to give a biaxially oriented film having a thickness of 75 μm.

The heat setting was carried out with an apparatus in which the heat setting zone was divided into $X_1$, $X_2$, $X_3$ and $X_4$ zones and the breadth of stenter rails in the zone ($X_1$) for a highest heat-setting temperature was decreased to shrink the film in the transverse direction.

The annealing was carried out by cooling the biaxially oriented, heat-set film by bringing it into contact with a cooling roll under tension, taking out a film having a width of 500 mm and a length of 500 mm from a taken-up film parent roll, taking it up about a take-up core having a diameter of 165 mm, and heating the taken-up film in a heating oven.

Each of the so-obtained annealed, biaxially oriented films was measured for tanδ, a refractive index (nz) in the thickness direction, an anti-curling ratio, a folded-line delamination whitening ratio, and the like. The results were as shown in Table 7.

TABLE 7

| | tan δ | Refractive index in thickness direction (nz) | Anti-curling ratio (%) | Haze (%) | Film thickness (μm) | Folded-line delamination whitening ratio (%) | Overall evaluation |
|---|---|---|---|---|---|---|---|
| Ex. 7 | 0.070 | 1.506 | 90 | 0.4 | 75 | 0 | Excellent |
| Ex. 8 | 0.075 | 1.506 | 80 | " | " | 0 | Excellent |
| Ex. 9 | 0.070 | 1.509 | 90 | " | " | 0 | Excellent |
| Ex. 10 | 0.070 | 1.499 | 90 | 0.3 | " | 10 | Excellent |
| CEx. 6 | 0.100 | 1.506 | 35 | 0.4 | " | 0 | Defective |
| CEx. 7 | 0.070 | 1.497 | 90 | 0.3 | " | 60 | Defective |

Ex. = Example, CEx. = Comparative Example

Examples 11–14 and Comparative Example 8

A polyethylene-2,6-naphthalenedicarboxylate having an intrinsic viscosity of 0.60 was melt-extruded through a die slit by a conventional method and cooled and solidified on a casting drum to prepare an unstretched film.

The above unstretched film was biaxially oriented and heat-set under tension under conditions shown in Table 8, and further, the resultant film was annealed under conditions shown in Table 8 to give a biaxially oriented film having a thickness of 75 μm.

The annealing was carried out by cooling the biaxially oriented, heat-set film by bringing it into contact with a cooling roll under tension, taking out a film having a width of 500 mm and a length of 500 m from a taken-up film parent roll, taking it up about a take-up core having a diameter of 165 mm, and heating the taken-up film in a heating oven.

TABLE 8

| | Stretching in longitudinal direction | | Stretching in transverse direction | | Heat setting | |
|---|---|---|---|---|---|---|
| | Stretch ratio | Temperature (°C.) | Stretch ratio | Temperature (°C.) | Temperature (°C.) | Annealing conditions |
| Ex. 11 | 3.2 | 130 | 3.5 | 135 | 230 | Condition A |
| Ex. 12 | 3.2 | 130 | 3.5 | 135 | 230 | Condition B |
| Ex. 13 | 3.0 | 130 | 3.3 | 135 | 235 | Condition A |
| Ex. 14 | 3.0 | 130 | 3.0 | 135 | 240 | Condition A |
| CEx. 8 | 3.2 | 130 | 3.5 | 135 | 230 | Not annealed |

Ex. = Example, CEx. = Comparative Example

The meanings of the annealing conditions in Table 8 are the same as those in Table 6.

The above-obtained, annealed biaxially oriented films were measured for tanδ (80° C.) in the longitudinal direction by tensile viscoelasticity at 0.05 Hz, a flatness and an anti-curling ratio, and the results were as shown in Table 9.

TABLE 9

| | tan δ | Flatness (cm/m-width) | Anti-curling ratio (%) | Refractive index $n_z$ | Haze value (%) | Overall evaluation |
|---|---|---|---|---|---|---|
| Ex. 11 | 0.070 | 150 | 90 | 1.500 | 0.3 | Excellent |
| Ex. 12 | 0.075 | 140 | 80 | " | " | Excellent |
| Ex. 13 | 0.070 | 200 | 90 | 1.503 | " | Excellent |
| Ex. 14 | 0.070 | 245 | 90 | 1.506 | 0.4 | Excellent |
| CEx. 8 | 0.100 | 70 | 35 | 1.500 | 0.3 | Defective |

Ex. = Example, CEx. = Comparative Example

Examples 15–18 and Comparative Example 9

A polyethylene-2,6-naphthalenedicarboxylate having an intrinsic viscosity of 0.60 was melt-extruded through a die slit by a conventional method and cooled and solidified on a casting drum to prepare an unstretched film.

The above unstretched film was biaxially oriented and heat-set under tension under conditions shown in Table 10, and further, the resultant film was annealed under conditions shown in Table 10 to give a biaxially oriented film having a thickness of 75 μm.

The annealing was carried out by cooling the biaxially oriented, heat-set film by bringing it into contact with a cooling roll under tension, taking out a film having a width of 500 mm and a length of 500 m from a taken-up film parent roll, taking it up about a take-up core having a diameter of 165 mm, and heating the taken-up film in a heating oven.

TABLE 10

| | Stretching in longitudinal direction | | Stretching in transverse direction | | Heat | |
|---|---|---|---|---|---|---|
| | Stretch ratio | Temperature (°C.) | Stretch ratio | Temperature (°C.) | setting | Annealing conditions |
| Ex. 15 | 3.0 | 135 | 3.0 | 135 | 230 | Condition A |
| Ex. 16 | 3.1 | " | 3.1 | " | " | Condition B |
| Ex. 17 | 3.1 | " | 3.6 | " | " | Condition A |
| Ex. 18 | 3.6 | " | 3.1 | " | " | " |
| CEx. 9 | 3.0 | " | " | " | 230 | Not annealed |

Ex. = Example, CEx. = Comparative Example

The meanings of the annealing conditions in Table 10 are the same as those in Table 6.

The above-obtained, annealed biaxially oriented films were measured for tanδ (80° C.) in the longitudinal direction by tensile viscoelasticity at 0.05 Hz, Young's moduli in the longitudinal and transverse directions, an anti-curling ratio and a dust occurrence state, and the results were as shown in Table 11.

TABLE 11

| | | Young's moduli (kg/mm$^2$) | | Refractive index $n_z$ | Haze value (%) | Anti-curing ratio (%) | Dust occurrence state | Overall evaluation |
|---|---|---|---|---|---|---|---|---|
| | tan δ | Longitudinal direction | Transverse direction | | | | | |
| Ex. 15 | 0.070 | 600 | 600 | 1.504 | 0.3 | 90 | ◎ | Excellent |
| Ex. 16 | 0.075 | 600 | 600 | 1.503 | " | 80 | ◎ | Excellent |
| Ex. 17 | 0.070 | 600 | 680 | 1.500 | " | 90 | ○ | Excellent |
| Ex. 18 | 0.070 | 680 | 600 | 1.499 | " | 90 | ○ | Excellent |
| CEx. 9 | 0.100 | 600 | 600 | 1.504 | " | 35 | ◎ | Defective |

Ex. = Example, CEx. = Comparative Example

Example 19 and Comparative Example 10

A polyethylene-2,6-naphthalenedicarboxylate having an intrinsic viscosity of 0.60 was melt-extruded through a die slit by a conventional method and cooled and solidified on a casting drum to prepare an unstretched film.

The above unstretched film was biaxially oriented and heat-set under tension under conditions shown in Table 12, and further, the resultant film was annealed under conditions shown in Table 12 to give a biaxially oriented film having a thickness of 75 μm.

The annealing was carried out in the same manner as in Examples 15 to 18.

Table 12 shows the properties of the so-obtained film.

Examples 20–23 and Comparative Examples 11–14

Annealed, biaxially oriented films were obtained in the same manner as in Examples 1 to 4 except that the polyethylene-2,6-naphthalenedicarboxylate was replaced with polyethylene-2,6-naphthalenedicarboxylate containing inert fine particles shown in Table 13 and having an intrinsic viscosity of 0.60.

Table 13 shows the properties of the above-obtained annealed, biaxially oriented films.

TABLE 12

| | Film-forming conditions | | | | Film Properties | | | | | | | |
|---|---|---|---|---|---|---|---|---|---|---|---|---|
| | Stretch ratio in longitudinal direction | Stretch ratio in transverse direction | Heat-setting temperature | Annealing conditions | Refractive index $n_z$ | Haze value (%) | tan δ | Anti-curing ratio | Heat shrinkage percentage (%) | Flatness (cm/m-width) | Blocking | Overall evaluation |
| Ex. 19 | 3.0 | 3.2 | 235 | A | 1.506 | 0.9 | 0.070 | 91 | 0.6 | 80 | ○ | ○ |
| CEx. 10 | 3.0 | 3.2 | 235 | Not annealed | " | " | 0.103 | 32 | 0.6 | 80 | ○ | X |

Ex. = Example, CEx. = Comparative Example

TABLE 13

| | Particles added | | | | Film | Annealing conditions | | Annealed film | |
|---|---|---|---|---|---|---|---|---|---|
| | Kind | Average particle diameter (μm) | Largest diameter/ smallest diameter | Amount (wt %) | thick-ness (μ) | Tempe-rature (°C.) | Time (hr) | Refrac-tive index $n_z$ | Haze (%) |
| Ex. 20 | crosslink-ed poly-styrene | 0.5 | 1.05 | 0.007 | 75 | 90 | 24 | 1.503 | 0.9 |
| Ex. 21 | crosslink-ed poly-styrene | " | " | " | " | 100 | " | " | " |
| Ex. 22 | crosslink-ed poly-styrene | " | " | 0.014 | " | 90 | " | " | 1.6 |
| Ex. 23 | crosslink-ed poly-styrene | " | " | " | " | 100 | " | " | " |
| CEx. 11 | crosslink-ed poly-styrene | " | " | 0.007 | " | not carried out | | " | 0.9 |
| CEx. 12 | crosslink-ed poly-styrene | " | " | " | " | 150 | " | " | " |
| CEx. 13 | crosslink-ed poly-styrene | " | " | 0.20 | " | 100 | " | " | 4.8 |
| CEx. 14 | massive silica | 2.5 | 1.9 | 0.007 | " | " | " | " | 2.5 |

| | Annealed film | | | | Evaluation for photographic film | | | |
|---|---|---|---|---|---|---|---|---|
| | Adher-ing degree (Grade %) | Form of anneal-ed roll of film | tan δ | Anti-curl-ing ratio (%) | Trans-paren-cy | Form of roll | Capabi-lity of recovery from curling | Overall evalua-tion |
| Ex. 20 | 3 | 2 | 0.075 | 80 | ○ | ○ | ○ | ○ |
| Ex. 21 | " | " | 0.070 | 90 | ○ | ○ | ○ | ○ |
| Ex. 22 | 2 | 1 | 0.075 | 80 | ○ | ○ | ○ | ○ |
| Ex. 23 | " | " | 0.070 | 90 | ○ | ○ | ○ | ○ |
| CEx. 11 | 3 | 2 | 0.10 | 35 | ○ | ○ | X | X |
| CEx. 12 | " | 4 | 0.092 | 55 | ○ | X | X | X |
| CEx. 13 | 1 | 1 | 0.070 | 90 | X | X | ○ | X |
| CEx. 14 | 4 | 4 | 0.070 | 90 | X | X | ○ | X |

Ex. = Example, CEx. = Comparative Example

Examples 24–27 and Comparative Examples 15–∫

Examples 1–4 were repeated. That is, annealed, biaxially oriented films were obtained in the same manner as in Examples 1 to 4 except that the polyethylene-2,6-naphthalenedicarboxylate was replaced with polyethylene-2,6-naphthalenedicarboxylate containing inert fine particles shown in Table 14 and having an intrinsic viscosity of 0.60.

Table 14 shows the properties of the above-obtained annealed, biaxially oriented films.

TABLE 14

| | Particles added | | | | Film | Annealing conditions | | Annealed film | |
|---|---|---|---|---|---|---|---|---|---|
| | Kind | Average particle diameter (μm) | Largest diameter/ smallest diameter | Amount (wt %) | thick-ness (μ) | Tempe-rature (°C.) | Time (hr) | Refrac-tive index nz | Haze (%) |
| Ex. 24 | spheri-cal silica | 0.3 | 1.07 | 0.005 | 75 | 90 | 24 | 1.503 | 0.9 |
| Ex. 25 | spheri-cal | " | " | " | " | 100 | " | " | " |

TABLE 14-continued

| | | | | | | | | | |
|---|---|---|---|---|---|---|---|---|---|
| Ex. 26 | silica spherical | " | " | 0.01 | " | 90 | " | " | 1.6 |
| Ex. 27 | silica spherical | " | " | " | " | 100 | " | " | " |
| CEx. 15 | silica spherical | " | " | 0.005 | " | not carried out | | " | 0.9 |
| CEx. 16 | silica spherical | " | " | 0.005 | " | 110 | 8 | " | 0.9 |
| CEx. 17 | silica spherical silica | " | " | 0.20 | " | " | 24 | " | 4.8 |

| | Annealed film | | | | | | Evaluation for photographic film | | | |
|---|---|---|---|---|---|---|---|---|---|---|
| | Adhering degree (Grade %) | Form of annealed roll of film | TK (°C.) | $\Delta H_k$ (mJ / mg) | Anti-curling ratio (%) | tan δ | Transparency | Form of roll | Capability of recovery from curling | Overall evaluation |
| Ex. 24 | 3 | 2 | 120 | 0.3 | 80 | 0.075 | ○ | ○ | ○ | ○ |
| Ex. 25 | " | " | 140 | 0.5 | 93 | 0.070 | ○ | ○ | ○ | ○ |
| Ex. 26 | 2 | 1 | 120 | 0.3 | 80 | 0.075 | ○ | ○ | ○ | ○ |
| Ex. 27 | " | " | 140 | 0.5 | 93 | 0.070 | ○ | ○ | ○ | ○ |
| CEx. 15 | 3 | 2 | no concerned peak | — | 35 | 0.10 | ○ | ○ | X | X |
| CEx. 16 | 3 | 2 | 140 | 0.1 | 40 | 0.095 | ○ | ○ | X | X |
| CEx. 17 | 1 | 1 | " | " | " | 0.070 | X | ○ | ○ | X |

Ex. = Example, CEx. = Comparative Example

It is seen that Examples 24 to 27 and Comparative Example 15 were good replications of Examples 1 to 4 and Comparative Example 1. It is also seen that the annealed films obtained in these Examples had desirable values of Tk(°C.) and ΔHk (mJ/mg).

Examples 28–31 and Comparative Example 18

A polyethylene-2,6-naphthalenedicarboxylate (intrinsic viscosity 0.60) containing spherical silica particles having a particle diameter ratio of 1.07 and an average particle diameter of 0.3 μm in an amount shown in Table 15 was melt-extruded by a conventional method to prepare an unstretched film.

The above unstretched film was biaxially oriented and heat-set under conditions shown in Table 15 to obtain a biaxially oriented film having a thickness of 75 μm. The heat-setting was carried out with an apparatus having a heat-setting zone which was divided into three zones of $X_1$, $X_2$ and $X_3$ and a cooling zone (cz) which was located thereafter. In the zone ($X_1$) having a highest heat-setting temperature, the film was shrunk in the transverse direction by narrowing the breadth of stenter rails.

TABLE 15

| | | | | | | Heat-setting zone | | | | CZ |
|---|---|---|---|---|---|---|---|---|---|---|
| | | Stretching in longitudinal direction | | Stretching in transverse direction | | $X_1$ | | $X_2$ | $X_3$ | temperature |
| | Silica content (wt %) | Stretch ratio | Temperature (°C.) | Stretch ratio | Temperature (°C.) | Temperature (°C.) | Shrinkage Percentage (%) | Temperature (°C.) | Temperature (°C.) | (°C.) |
| Ex. 28 | 0.002 | 3.0 | 135 | 3.1 | 145 | 240 | 6 | 215 | 180 | 110 |
| Ex. 29 | 0.003 | 3.0 | 135 | 3.1 | 145 | 240 | 6 | 215 | 180 | 110 |
| Ex. 30 | 0.005 | 3.0 | 135 | 3.1 | 145 | 240 | 6 | 215 | 180 | 110 |
| Ex. 31 | 0.002 | 3.0 | 135 | 3.3 | 145 | 235 | 6 | 215 | 180 | 110 |
| CEx. 18 | 0.002 | 3.0 | 135 | 3.3 | 145 | 220 | 6 | 215 | 180 | 110 |

Ex. = Example, CEx. = Comparative Example

Each of the above-obtained biaxially oriented films was measured for a refractive index (nz), scratch resistance, etc. The results were as shown in Table 16.

TABLE 16

| | Refractive index in thickness direction (nz) | Haze value (%) | tan δ | Anti-curl-ling ratio (%) | Scratch resis-tance | Film thick-ness (μm) |
|---|---|---|---|---|---|---|
| Ex. 28 | 1.505 | 0.7 | 0.075 | 90 | A | 75 |
| Ex. 29 | 1.505 | 0.8 | " | " | B | " |
| Ex. 30 | 1.505 | 1.0 | " | " | B | " |
| Ex. 31 | 1.500 | 0.7 | 0.070 | " | A | " |
| CEx. 18 | 1.497 | 0.5 | 0.065 | " | C | " |

Ex. = Example, CEx. = Comparative Example

Examples 32–35 and Comparative Examples 19–20

A polyethylene-2,6-naphthalenedicarboxylate having an intrinsic viscosity of 0.60 was melt-extruded by a conventional method to prepare an unstretched film.

The above unstretched film was biaxially oriented and heat-treated under conditions shown in Table 17 to give a biaxially oriented film having a thickness of 75 μm. The heat treatment was carried out with an apparatus of which the heat-treatment zone was divided into four zones of $X_1$, $X_2$, $X_3$ and $X_4$. The zone ($X_1$) having a highest heat-setting temperature was arranged such that the breadth of stenter rails was narrowed to shrink the film in the transverse direction.

TABLE 17

| | Stretching in longi-tudinal direction | | Stretching in trans-verse direction | | Heat-setting zone | | | | |
|---|---|---|---|---|---|---|---|---|---|
| | | | | | $X_1$ | | $X_2$ | $X_3$ | $X_4$ |
| | Stretch ratio | Temperature (°C.) | Stretch ratio | Temperature (°C.) | Tempe-rature (°C.) | Shrin-kage tage (%) | Tempe-rature (°C.) | Tempe-rature (°C.) | Tempe-rature (°C.) |
| Ex. 32 | 2.7 | 135 | 3.0 | 145 | 230 | 6 | 200 | 170 | 110 |
| Ex. 33 | 3.0 | 135 | 3.3 | 145 | 240 | 0 | 215 | 180 | 110 |
| Ex. 34 | 2.7 | 135 | 3.0 | 145 | 240 | 2 | 215 | 180 | 110 |
| Ex. 35 | 3.0 | 135 | 3.0 | 145 | 240 | 6 | 215 | 180 | 110 |
| CEx. 19 | 3.6 | 135 | 3.8 | 145 | 240 | 6 | 215 | 180 | 110 |
| CEx. 20 | 3.0 | 135 | 3.3 | 145 | 220 | 6 | 215 | 180 | 110 |

Ex. = Example, CEx. = Comparative Example

Each of the above-obtained biaxially oriented films was measured for a refractive index (nz) in the thickness direction, thickness non-uniformity in the longitudinal and transverse directions, flatness and a folded-line delamination whitening ratio.

The results were as shown in Table 18.

TABLE 18

| | Refractive index in longi-tudinal direction (nz) | Haze value (%) | tan δ | Anti-curl-ling ratio (%) | Thickness non-uniformity in longi-tudinal direction (μm) | Thickness non-uniformity in transverse direction (μm) | Flatness (mm/m-width) | Folded-line delamina-tion whitening ratio % | Overall evalu-tion |
|---|---|---|---|---|---|---|---|---|---|
| Ex. 32 | 1.499 | 0.3 | 0.070 | 90 | 3.6 | 3.5 | 80 | 10 | Excellent |
| Ex. 33 | 1.503 | 0.4 | " | " | 4.8 | 4.6 | 230 | 2 | Excellent |
| Ex. 34 | 1.509 | " | " | " | 3.9 | 3.7 | 180 | 0 | Excellent |
| Ex. 35 | 1.506 | " | " | " | 3.8 | 3.8 | 120 | 0 | Excellent |
| CEx. 19 | 1.494 | " | " | " | 3.0 | 3.0 | 50 | 85 | Defective |
| CEx. 20 | 1.497 | 0.3 | 0.065 | " | 3.4 | 3.3 | 70 | 60 | Defective |

Ex. = Example, CEx. = Comparative Example

Example 36 and Comparative Example 21

A polyethylene-2,6-naphthalenedicarboxylate containing 0.008% by weight of spherical silica (long diameter/short diameter=1.07) having an average particle diameter of 0.3 μm and having an intrinsic viscosity of 0.60 was melt-extruded through a die slit and the extrudate was rapidly cooled and solidified on a casting drum to prepare an unstretched film. Then, this unstretched film was stretched 3.0 times in the longitudinal direction at a temperature of 130° C. and then stretched 3.3 times in the transverse direction at a temperature of 135° C. while holding both sides of the film in the transverse direction with stenter clips, and the stretched film was heat-set under tension at 230° C. Then, the film was released from the holding, and rapidly cooled by contacting it to a quenching roll, and the film was taken up around a roll to give a parent roll.

A film having a width of 500 mm and a length of 500 m from the above-obtained parent roll was taken up around a take-up core having a diameter of 165 mm to form a roll, and in this case, the taking-up was carried out with inserting polyethylene-2,6-naphthalenedicarboxylate film having a thickness of 10 μm and a width of 10 mm in both edge portions of the above film roll (width 500 mm). This film roll was annealed under conditions shown in Table 19.

The physical properties of the annealed biaxially oriented film and the evaluations thereof as a photosensitive material for photography were as shown in Table 19.

TABLE 19

| | Film | Annealed parent roll | | Anneal- | Annealed film | | | | Evaluation for photographic film | | | |
|---|---|---|---|---|---|---|---|---|---|---|---|---|
| | thick-ness (μm) | Take-up method | Proportion of air layer (%) | ing con-ditions | Refractive index ($n_z$) | Haze value (%) | tan δ | Anti-curl-ing ratio (%) | Trans-paren-cy | Property of recovery from curling | Block-ing | Overall evalua-tion |
| Ex. 36 | 75 | A 10 μm thick film inserted in edge portions | 13 | Con-dition A | 1.503 | 1.3 | 0.070 | 90 | ○ | ○ | ○ | ○ |
| CEx. 21 | " | A 10 μm thick film inserted in edge portions | " | No | " | " | 0.100 | 35 | ○ | X | ○ | X |

Ex. = Example, CEx. = Comparative Example

The biaxially oriented film obtained in Example 36 is a roll with a proper air layer and has a predetermined haze value and a predetermined tanδ value, and as a result, it satisfies the properties which it is required to have as a photosensitive material for photography.

Examples 34–41 and Comparative Examples 22–24

Polyethylene-2,6-naphthalenedicarboxylates containing spherical silica having an average particle diameter of 0.3 μm and a particle diameter ratio (largest diameter/smallest diameter) of 1.05 in an amounts shown in Table 20 and having an intrinsic viscosity of 0.60 were respectively melted according to a conventional method, and co-extruded through adjacent dies, to form a layer (A) and layers (B), so that one layer (B) was laminated on, and fused to, one surface of the layer (A) and that the other layer (B) was laminated on, and fused to, the other surface of the layer (A). The laminate was rapidly cooled and solidified to prepare an unstretched laminated film.

Then, the above unstretched film was stretched 3.0 times in the longitudinal direction at a temperature of 130° C., and then stretched 3.3 times in the transverse direction at a temperature of 135° C. while holding both sides of the film in the transverse direction with stenter clips, and further, the stretched film was heat set under tension at 230° C. Then, the film was released from the holding, and cooled by contacting it to a quenching roll under tension to give a biaxially oriented laminated film.

Thereafter, the above-obtained film was annealed under conditions shown in Table 20 to give a film having a total thickness of 75 μm. The thickness of each of the layer (A) and the layers (B) was changed as shown in Table 20.

The annealing was carried out by withdrawing a film having a width of 500 mm and a length of 500 m from the above-obtained patent roll, taking it up in the form of a roll and heating it in a heating oven. Table 20 also shows the properties of the obtained, annealed film.

TABLE 20

| | Layer (A) | | Layer (B) | | |
|---|---|---|---|---|---|
| | Silica content (wt %) | Thick-ness (μm) | Silica content (wt %) | Thick-ness (μm) | Annealing conditions |
| Ex. 37 | 0.001 | 65 | 0.01 | 5 | Condition A |
| Ex. 38 | 0.001 | 65 | 0.01 | 5 | Condition B |
| Ex. 39 | 0 | 55 | 0.01 | 10 | Condition A |
| Ex. 40 | 0.001 | 65 | 0.005 | 5 | " |

TABLE 20-continued

| | | | | | |
|---|---|---|---|---|---|
| Ex. 41 | 0.001 | 67 | 0.05 | 3 | " |
| CEx. 22 | 0.001 | 65 | 0.01 | 5 | Not annealed |
| CEx. 23 | 0.02 | 65 | 0.01 | 5 | Condition A |
| CEx. 24 | 0.001 | 65 | 0.12 | 5 | " |

| | Refrac-tive index $n_z$ | tan δ | Haze (%) | Anti-curl-ing ratio (%) | Adher-ing degree (grade) | Form of taken-up film (grade) | Over-all evalua-tion |
|---|---|---|---|---|---|---|---|
| Ex. 37 | 1.503 | 0.070 | 0.8 | 90 | 2 | 1 | Excel-lent |
| Ex. 38 | " | 0.075 | 0.8 | 80 | 2 | 1 | Excel-lent |
| Ex. 39 | " | 0.070 | 0.9 | 90 | 2 | 1 | Excel-lent |
| Ex. 40 | " | 0.070 | 0.7 | 90 | 3 | 2 | Excel-lent |
| Ex. 41 | " | 0.070 | 1.7 | 90 | 1 | 1 | Excel-lent |
| CEx. 22 | " | 0.100 | 0.8 | 35 | 2 | 1 | De- |

TABLE 20-continued

| | | | | | | | |
|---|---|---|---|---|---|---|---|
| CEx. 23 | " | 0.070 | 2.8 | 90 | 2 | 1 | fective Defective |
| CEx. 24 | " | 0.070 | 3.9 | 90 | 0 | 1 | Defective |

Ex. = Example, CEx. = Comparative Example
The meanings of the annealing conditions in Table 20 are the same as those in Table 6.

Examples 42–44 and Comparative Examples 25–27

Polyethylene-2,6-naphthalenedicarboxylates containing spherical silica having an average particle diameter shown in Table 21 and a particle diameter ratio (largest diameter/smallest diameter) of 1.05 in an amounts shown in Table 20 and having an intrinsic viscosity of 0.60 were respectively melted according to a conventional method, and co-extruded through adjacent dies, to form a layer (A) and layers (B), so that one layer (B) was laminated on, and fused to, one surface of the layer (A) and that the other layer (B) was laminated on, and fused to, the other surface of the layer (A). The laminate was rapidly cooled and solidified to prepare an unstretched composite film. In this case, the thickness of each of the layer (A) and the layers (B) was adjusted by changing the output from each extruder.

Then, the above unstretched film was stretched 3.0 times in the longitudinal direction at a temperature of 130° C., and then stretched at a stretch ratio shown in Table 21 in the transverse direction at a temperature of 135° C. while holding both sides of the film in the transverse direction with stenter clips, and further, the stretched film was heat set under tension at a temperature shown in Table 21. Then, the film was released from the holding, and rapidly cooled by contacting it to a quenching roll under tension to give a biaxially oriented composite film having a total thickness of 75 μm. Thereafter, the above film was annealed under Condition A in Examples 7–10. The thickness of each of the layer (A) and the layers (B) was changed as shown in Table 21.

The above-obtained film was measured for a haze, a refractive index (nz) in the thickness direction, scratch resistance, etc. The results were as shown in Table 21.

TABLE 21

| | Layer A | | | Layer B | | | | Stretch | Heat | Film properties | | | | | |
|---|---|---|---|---|---|---|---|---|---|---|---|---|---|---|---|
| | Particle diameter (μm) | Content (wt %) | Thickness (μm) | Particle diameter $d_B$ (μm) | Content (wt %) | Thickness $t_B$ | $t_B/d_B$ | ratio in transverse direction | setting temperature (°C.) | Anti-curling ratio (%) | tan δ | Haze (%) | nz | Scratch resistance | Overall evaluation |
| Ex. 42 | — | 0 | 73.0 | 0.7 | 0.04 | 1.0 | 1.4 | 3.1 | 240 | 90 | 0.070 | 1.5 | 1.505 | A | |
| Ex. 43 | — | 0 | 73.0 | 0.1 | 0.2 | 1.0 | 10 | 3.1 | 240 | " | " | 1.8 | 1.505 | A | |
| Ex. 44 | 0.3 | 0.002 | 72.0 | 1.2 | 0.04 | 1.5 | 1.3 | 3.1 | 235 | " | " | 1.9 | 1.500 | B | |
| CEx. 25 | — | 0 | 55.0 | 0.7 | 0.04 | 10.0 | 14.3 | 3.1 | 240 | " | " | 4.1 | 1.505 | C | X |
| CEx. 26 | — | 0 | 73.0 | 0.7 | 0.6 | 1.0 | 1.4 | 3.1 | 240 | " | " | 6.5 | 1.505 | C | X |
| CEx. 27 | — | 0 | 71.0 | 1.6 | 0.1 | 2.0 | 1.3 | 3.1 | 235 | " | " | 3.7 | 1.500 | C | X |

We claim:

1. A base film for a photographic film wherein (a) the refractive index (nz) in the thickness direction is at least 1,498, (b) the haze value is 2.0% or less, (c) the base film has one direction in which the tanδ value, at 80° C. by tensile viscoelasticity at 0.05 Hz, is less than 0.085, (d) the anti-curling ratio at 70° C. is at least 45%, (e) the thickness is in the range of from 40 to 120 μm, and (f) the base film is formed form polyethylene-2,6-napthalenedicarboxylate as a raw material.

2. The base film of claim 1, wherein the refractive index (nz) in the thickness direction is 1.510 or less.

3. The base film of claim 1, wherein the haze value is 1.5% or less.

4. The base film of claim 1, wherein the tanδ value, at 80° C. by tensile viscoelasticity at 0.05 Hz, is 0.08 or less.

5. The base film of claim 1, wherein the anti-curling ratio at 70° C. is at least 50%.

6. The base film of claim 1, wherein the base film has a net ANSI curl value of 10 or less when the base film is heat-treated and core set on a core having an outer diameter of 3 inches at 49° C. at 50% RH for 24 hours.

7. The base film of claim 1, wherein the polyethylene-2,6-naphthalenedicarboxylate contains at least 97 mol % of ethylene-2,6-naphthalenedicarboxylate units.

8. The base film of claim 1, wherein the base film has a film/film adhering degree of grade 3 or lower.

9. The base film of claim 1, wherein the base film has a flatness of 250 cm/m-width or less.

10. The base film of claim 1, wherein the base film has an endothermic peak in a temperature range of from 120° to 160° C. and its endothermic energy is at least 0.3 mJoul/mg.

11. The base film of claim 1, wherein the base film has one direction in which the base film has a heat shrinkage percentage of 3% or less when dry-heat treated at 150° C. for 30 minutes.

12. The base film of claim 1, wherein the base film has one direction in which the base film has a thickness nonuniformity of 5 μm or less.

13. The base film of claim 1, wherein the base film has two directions crossing each other at right angles in which the base film has Young's moduli of 750 kg/mm$^2$ or less.

14. The base film of claim 1, wherein the base film contains 0.001 to 0.2% by weight of inert fine particles having an average particle diameter of 0.05 to 1.5 μm.

15. A roll of a base film for a photographic film, wherein the roll has a space formed of 7 to 20% by volume of air between films and a roll film is the base film as recited in claim 1.

16. A photographic film comprising a photographic emulsion layer and the base film recited in claim 1 as the base film.

17. A base film for a photographic film, wherein (a) the refractive index (nz) in the thickness direction is at least 1.498, (b) the haze value is 2.0% or less, (c) the base film has one direction in which the tanδ value, at 80° C. by tensile viscoelasticity at 0.05 Hz, is 0.09 or less, (d) the anti-curling ratio at 70° C. is at least 45%, (e) the thickness is in the range of from 40 to 120 μm, and (f) the base film is formed of a laminated film formed of a first layer of polyethylene-2,6-naphthalenedicarboxylate containing less than 0.003% by weight of inert fine particles having an average particle diameter of 0.01 to 1.15 μm and a second layer of polyethylene-2,6-naphthalenedicarboxylate containing 0.003 to 0.5% by weight of inert fine particles having a average particle diameter of 0.01 to 1.15 μm, the second layer having a thickness of 10 μm or less.

18. The base film of claim 17 wherein a ratio of the thickness $t_2$ (μm) of the second layer to the particle diameter $d_2$ (μm) of the inert fine particles contained in the second layer is in the range of from 0.1 to 10.

19. The base film of claim 17, wherein the second layer has a thickness of 5 μm or smaller.

20. A photographic film, comprising a photographic emulsion layer and a base film wherein in the base film (a) the refractive index (nz) in the thickness direction is 1.498 to 1.510, (b) the haze value is 1.5 % or less, (c) the base film has one direction in which the tanδ value, at 80° C. by tensile viscoelasticity at 0.05 Hz, is 0.06 to 0.08, (d) the anti-curling ratio at 70° C. is at least 50%, (e) the thickness is in the range of from 40 to 120 μm, and (f) the base film contains at least 97 mol % of polyethylene-2,6-naphthalenedicarboxylate, and wherein the base film has two directions crossing each other at right angles in which the base film has Young's moduli of 400 to 750 kg/mm$^2$ in each direction and the Young's modulus difference between the two directions is 150 kg/mm$^2$ or less, and the base film has a net ANSI curl value of 10 or less when the base film is heat-treated and core set on a core having an outer diameter of 3 inches at 49° C. at 50% RH for 24 hours.

21. The base film of claim 20, wherein the base film contains 0.001 to 0.2% by weight of inert fine particles having an average particle diameter of 0.05 to 1.5 μm.

22. The base film of claim 20, wherein the base film has an endothermic peak in a temperature range of form 120° to 160° and its endothermic energy is at least 0.3 mJoul/mg.

23. The base film of claim 20, wherein the base film has one direction in which the base film has a heat shrinkage percentage of 3% or less when dry-heat treated at 150° C. for 30 minutes.

24. The base film of claim 20, wherein the base film has one direction in which the base film has a thickness non-uniformity of 5 μm or less.

* * * * *